US005634555A

United States Patent [19]

Dunham

[11] Patent Number: 5,634,555

[45] Date of Patent: Jun. 3, 1997

[54] PACKAGE FOR SHIPPING-DISPENSING COMMUNION CUPS

[76] Inventor: Sherman D. Dunham, 48W323 Keslinger Rd., Maple Park, Ill. 60151

[21] Appl. No.: 459,106

[22] Filed: Jun. 2, 1995

[51] Int. Cl.[6] ..... A45C 11/00; B65D 77/26

[52] U.S. Cl. ..... 206/19; 206/217; 206/499; 206/589; 211/59.4; 211/72

[58] Field of Search ..... 206/19, 217, 499, 206/526, 589, 426, 443, 446, 564, 516; 211/59.4, 49.1, 72–74; 248/152; 141/240, 237, 239, 236

[56] References Cited

U.S. PATENT DOCUMENTS

| | | | |
|---|---|---|---|
| 905,449 | 12/1908 | Morton | 206/589 X |
| 1,110,051 | 9/1914 | Harpster | 206/19 |
| 1,199,987 | 10/1916 | Husted | 206/19 |
| 2,851,154 | 9/1958 | Dirgeldein | 206/19 |
| 3,039,881 | 6/1962 | Shapiro | 206/499 X |
| 3,414,132 | 12/1968 | Cornu | 206/499 X |
| 3,654,746 | 4/1972 | Becker | 206/499 X |
| 4,349,109 | 9/1982 | Scordato et al. | 206/499 X |
| 4,640,418 | 2/1987 | Lowny | 206/499 |
| 4,826,012 | 5/1989 | Kosanovich | 206/499 |

FOREIGN PATENT DOCUMENTS

| | | | |
|---|---|---|---|
| 686657 | 3/1965 | Italy | 206/499 |
| 474858 | 11/1937 | United Kingdom | 206/499 |

OTHER PUBLICATIONS

Translated copy of Golfredo.

*Primary Examiner*—Bryon P. Gehman
*Attorney, Agent, or Firm*—John L. Schmitt

[57] ABSTRACT

The Christian sacrament of communion, particularly in Protestant churches, most often includes the service of wine or the like in small, individual disposable cups. These cups, selectively packaged in cartons, are transferred to trays for filling and subsequent service. To facilitate this transfer each carton includes a stack of spaced apart cup dividers and a top shipping divider. Each divider has a set of selectively arranged openings. Positioned over each cup divider opening is an open end of an inverted cup. Cups on lower cup dividers extend upward through the openings in the above divider. For cup transfer sides panels and a top panel of the carton are folded away. After removal of the shipping divider, an insert of a communion tray is placed up-side-down over the cups on the top cup divider so that the cups fit into holes in the tray insert. Next, a base of the tray is fitted over the insert to reform the tray. The tray, cups, and divider then are lifted from the divider stack and inverted. Lastly, the cup divider is discarded. Further communion trays may filled with cups in a like manner.

11 Claims, 3 Drawing Sheets

PACKAGE FOR SHIPPING-DISPENSING COMMUNION CUPS

BACKGROUND OF THE INVENTION

1. Field of Invention

This invention relates to packaging for cups and more particularly to a package for communion cups which facilitates placement in the cups in a communion tray.

2. Prior Art

Use of individual cups for serving wine or a non-alcoholic beverage as part of the Christian sacrament of communion has been the custom in Protestant churches for many years. Recently, glass cups have been replaced by disposable plastic cups. As theretofore packaged only in tightly nested stacks, such cups are individually hand placed in cup insert holes of a communion tray for filling and then service.

Other than simple nesting, specialized packaging and stacking means for cup shaped containers has been known and in use for many years.

U.S. Pat. No. Re. 13,465 discloses one early example of one such package which is particularly adapted for shipping lamp shades. This package includes a set of horizontal support members having respective openings to secure a lower portion of a shade. The support members are separated by circular spacing members respectively formed by joining scored ends of elongated strips. A series of support members are used to secure a like number of shades in a vertical array in the package.

A tray particularly adapted for storing just washed coffee cups and which then allows vertical stacking of cup filled trays is set out in U.S. Pat. No. 2,941,663. On a top side of each tray is a series of spaced apart projections that fit respectively inside open ends of a set of inverted cups. These projections then form complementary recesses on a bottom side of the tray which fit on top of bottoms of cups on a tray below. Ribs connecting the projections hold the cups above the tray top side to prevent cup contact with any rising liquid on the tray and allow air to circulate inside the cups. U.S. Pat. No. 3,369,659 shows a like tray improved by inclusion of a hole in each projection that promotes air circulation inside the cup.

Another stacking device, which in this case is a pallet, is disclosed U.S. Pat. No. 3,756,429. On a top side of the pallet is a series of projections spaced apart to hold bottoms of a series of cup-shaped containers. On a bottom side of the pallet is a set of ribs defining spaces for respective tops of further containers held by a pallet located below. A further stacking arrangement particularly adapted for culture vessels is set out in U.S. Pat. No. 4,599,314.

Lastly, a pipette tip packing system is disclosed in recently issued U.S. Pat. No. 5,324,482. This system includes a card having openings to hold lower ends of a set of pipette tips. The system further includes a transfer plate having a downward extending latching mechanism and a series of downward facing projections. To move a card carrying a set of pipette tips, the plate latching mechanism is inserted into a latching aperture in the card while the plate projections are fitted into open top ends of the pipette tips. Using an upper portion of the latching mechanism as a handle, bottom ends of the pipettes tips are inserted into another set of pipette tips carried by a lower card until the card seats on upper ends of a lower pipette tip set. Upon release of the latching mechanism the card may be removed leaving the pipette tip sets and their respective cards in a stacked relationship.

SUMMARY OF THE INVENTION

A package of this invention is particularly adapted for shipping disposable communion cups to churches and then allowing church members to quickly transfer these cups to communion trays for subsequent filling and service.

The inventive package includes a carton having readily fold-away sidewall panels and a backwall-top panel. Inside the carton is a stack of cup dividers and a top shipping divider spaced apart by spacer strips. Each divider is formed with a set of selectively arranged openings.

Positioned over each cup divider opening is an open end of an inverted cup. Vertical spacing of the dividers is such that cups on a lower divider extend up and through respective openings in an above divider and into the inverted cups on that above divider. There are no cups on the top shipping divider. Typically, the package contains 15 cup dividers having 40 openings each to hold a total of 600 cups.

For transferring the cups from the package to a communion tray, first the sidewall and top-backwall panels of the carton are folded down and away to provide ready access to the stack of dividers in the carton. Second, the top shipping divider and spacer strips on the uppermost cup divider are removed and discarded. A cup-holding insert of the tray then is placed upside-down over the cups on the uppermost cup divider so that the cups fit into holes in the tray insert. Next, a base of the tray is pressed onto the insert to reform the tray. The divider, cups, and tray then are lifted from the stack and inverted. Lastly, the divider is discarded leaving the now cup-filled tray ready for filling.

The package of this invention provides several advantages over known cup packages or other like packages presently in use.

A first and primary advantage is that this package allows cups to be transferred from the carton to fully fill a communion tray in a matter of seconds. Theretofore, it was not untypical for the time to hand-fill a tray with individual cups to be measured in minutes. There are several reasons for this improved result.

First, the package has prearranged the cups to align with the holes in the communion tray insert, and this alignment is maintained during shipping of the package and tray filling from the package. Note that during shipping cup dislocation is inhibited by both the divider openings and cup nesting. Then, during tray insert cup insertion, cups on an upper divider are held in place by the cups on the divider below. At the same time movement of the holding cups is limited by the openings in the upper divider. Therefore, cups on the upper divider remain ready for placement in the holes in the inverted tray insert.

A still further reason for ready transfer is that there is no cup-to-cup lock-up or cup-to-divider lock-up. Divider spacing insures loose cup nesting and loose fits of the cups in the divider openings.

Additionally, the dividers are spaced sufficiently apart to allow easy gripping of edges of a divider when the divider, cups, and tray are lifted from the divider stack and then inverted.

A last reason is that there are no interference fits between the divider openings and the cups to inhibit disposal of the divider after inversion. Note that the edge defining the cup open end seats on the divider.

A further advantage of this inventive package is that the cups remain free from hand transmittable disease causing germs and the like. Filling communion trays with cups typically is performed by volunteer help. In some cases such persons may not appreciate the importance following strict sanitary procedures for dispensing a beverage to large numbers of people.

Finally, the package is compact and light weight which is important for shipping and storage, but the package still holds 600 cups.

DESCRIPTION OF THE PREFERRED EMBODIMENT

Figure 1:
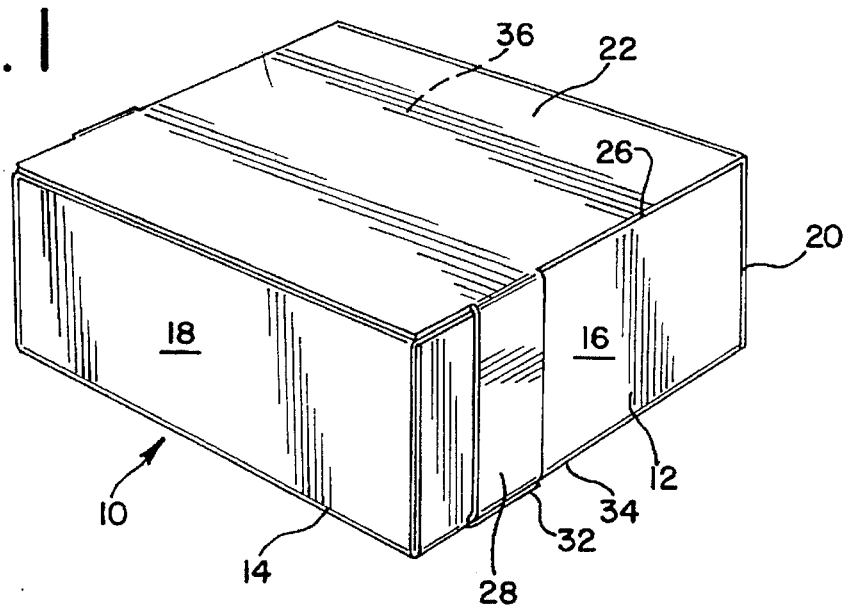
FIG. 1 is a perspective view of a communion cup package of this invention wherein a carton of the package is shown in closed condition.
Figure 2:
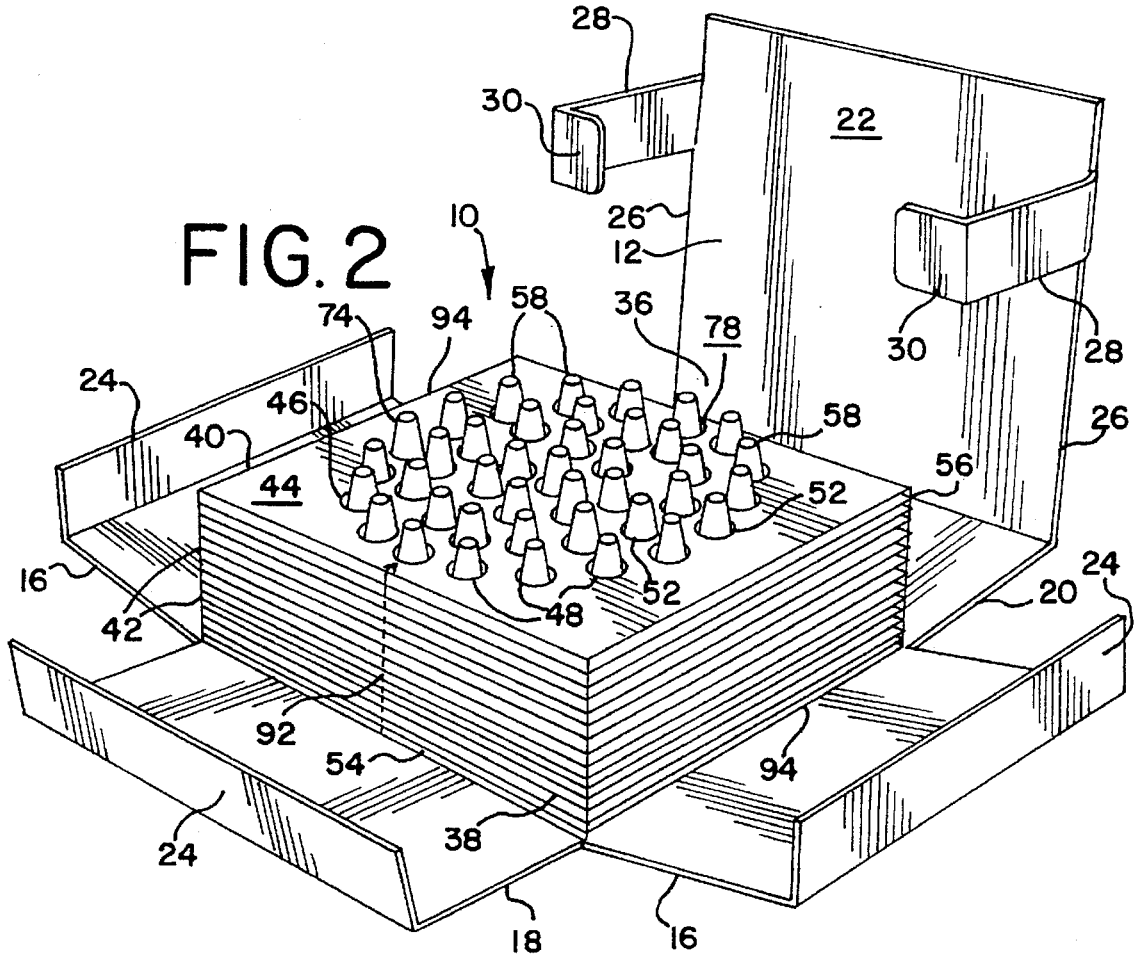
FIG. 2 is a perspective view of the package of FIG. 1 wherein the carton has been opened to provide access to a stack of cup carrying dividers in the carton.

A communion cup package of this invention is seen generally in FIGS. 1 and 2 and designated 10. The package 10 includes a box-shaped carton 12 defined by a bottom panel 14, sidewall panels 16, a front wall panel 18, and a back wall panel 20 connecting with a top panel 22. The sidewall and front wall panels 16, 18 are formed with end flanges 24.

Integrally joined to each side edge 26 of the top panel 22 is an L-shaped strap 28. During shipping and storage end tabs 30 of the straps 28 fit respectively into slotted openings 32 in folded edges 34 between the each sidewall panel 16 and bottom panel 14 to define an inner space 36 in the carton 12.

Figure 4:
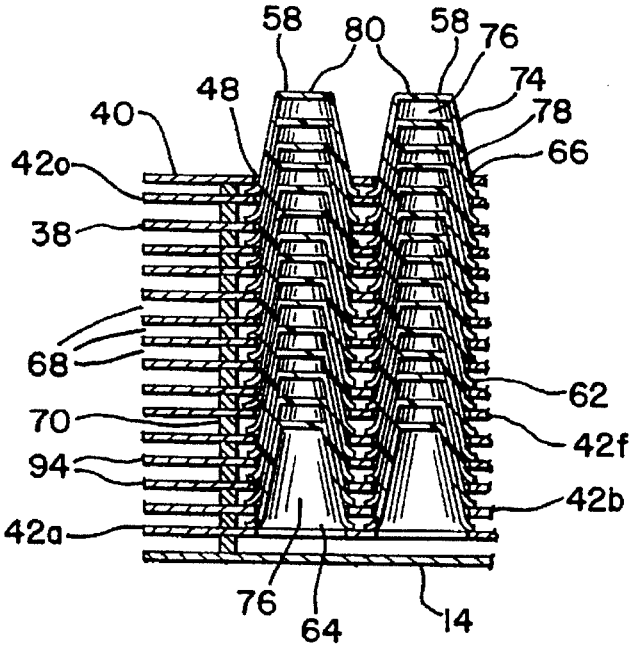
FIG. 4 is a cross sectional view of a portion of the divider stack as seen generally along the line 4—4 in FIG. 3. For the purpose of explanation a shipping divider has been included.
Figure 5:
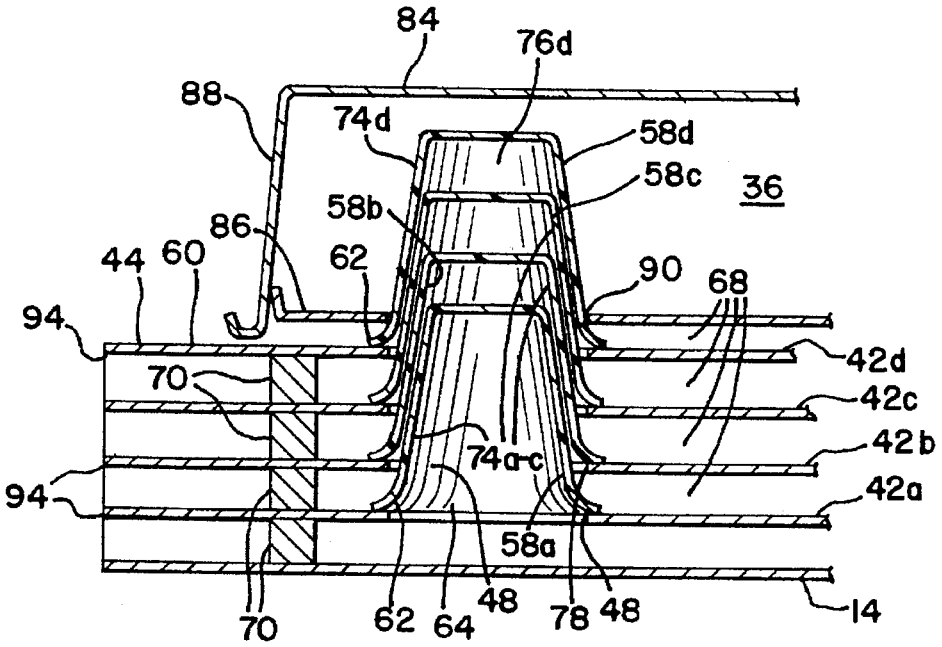
FIG. 5 is a detailed cross sectional view showing a portion of a base and insert of a communion tray positioned over a portion of a cup divider and its cups for subsequent removal of the divider, cups and tray from the stack of dividers.

As seen in FIGS. 2, 4, and 5 seated on the bottom panel 14 of the carton 12 is a stack 38 of dividers comprising a top shipping divider 40 and 15 cup dividers 42. When necessary to identify particular cup dividers 42, the cup dividers 42 and associated structure include a letter designation which have been assigned in ascending order. The bottom cup divider is identified 42*a*, the next above cup divider 42*b* and so forth through 42*o* for the uppermost cup divider.

The shipping divider 40 and the cup dividers 42 each include a flat panel 44 having a set 46 of cup openings 48. As the sets 46 are arranged, there is one center cup opening 50 which is surrounded by three concentrically arranged rows 52 of cup openings 48 so that the shipping divider 40 and each cup divider 42 has a total of 40 cup openings 48. Connecting with each divider panel 44 is a downward turned front flange 54 and a rear flange 56.

As seen in FIGS. 4 and 5, inverted communion cups 58 are positioned on a top surface 60 of each cup divider panel 44 to fit over the cup openings 48 therein. As located, edges 62 of open ends 64 of the cups 58 seat on the cup divider panel top surface 60. Note that there are no cups 58 on the shipping divider 40.

As the dividers 40, 42 are stacked, the cup openings 48 are vertically aligned to form columns 66 of openings 48. Spacing 68 between the dividers 40, 42 in the stack 38 are effected respectively pairs of side spacer strips 70 and center spacer strips 72, see FIGS. 3 and 4. The side spacer strips 70 are ¼ in. thick pieces of foam material. Each center spacer strip 72 is L-shaped, made of cardboard, and located next to the cup 58 fitted over the divider center cup opening 50.

The space 68 between dividers 40, 42 is less than a height of a cup 58. The cups 58 are about 1¼ in. high while the spaces 68 measure about ¼ in. Therefore, as stacked, closed base portions 74 of cups 58 on a lower cup divider 42 extend up through the openings 48 in the next above cup divider 42 or the shipping divider 40 and into inner spaces 76 of the cups 58 on that next above cup divider 42. A fit 78 between the cup base portion 74 and the cup divider and shipping divider opening 48 is loose. Additionally, the cup base portion 74 nests loosely in the inner space 76 of the cup 58 seated on that next above cup divider 42.

At one time four cups 58 nest or overlap. For example, as seen in FIG. 5, in the inner space 76*d* of a cup 58*d* on the cup divider 42*d* are the closed base portions 74*a–c* of cups 58*a–c* carried respectively on the cup dividers 42*a–c*.

During shipment of the package 10, the carton panels 16–22 and straps 28 hold the dividers 40, 42 in place in the carton inner space 36. At the same time the spacing 68 between the dividers 40, 42 in the stack 38 is preserved by the side and center spacer strips 70, 72. Lastly, the cups 58 are maintained in loosely nested sleeves 80 by the respective loose interference fits 78 between the base portion 74 of each cup 58 and the cup opening 48 in the above cup divider 42 or shipping divider 40.

To transfer cups 58 from the package 10 to a communion cup tray 84, first the panels 16–22 of the carton 12 are folded outward and away from the stack 38 of dividers 40, 42 in the carton 12, see FIG. 2. Next, the top shipping divider 40 and spacers strips 70, 72 on the uppermost cup divider 42*o* are removed and discarded.

A cup insert 86 from the tray 84 is separated from a base 88 of the tray 84 and the tray insert 86 placed upside down over cups 58 on the uppermost cup divider 42 so that the cups 58 fit into holes 90 in the insert 86. This is shown typically in FIG. 5 where the uppermost divider is cup divider 42*d*. In practice, the first cups 58 to be transferred are cups 58*o* on the cup divider 42*o*. Except as discussed below, regardless of which cup divider 42 is the uppermost cup divider 42, cup nesting deters movement of the cups 58 as the cups 58 pass into the holes 90 of the tray insert 86.

Note, it may be necessary to identify the master hole in the tray insert 86 if not already so marked. Different tray manufacturers use different cup hole configurations for their respective tray inserts. The packages 10 are furnished with cups 58 selectively located to align with the tray insert cup holes 90 of particular tray manufacturers.

Figure 3:
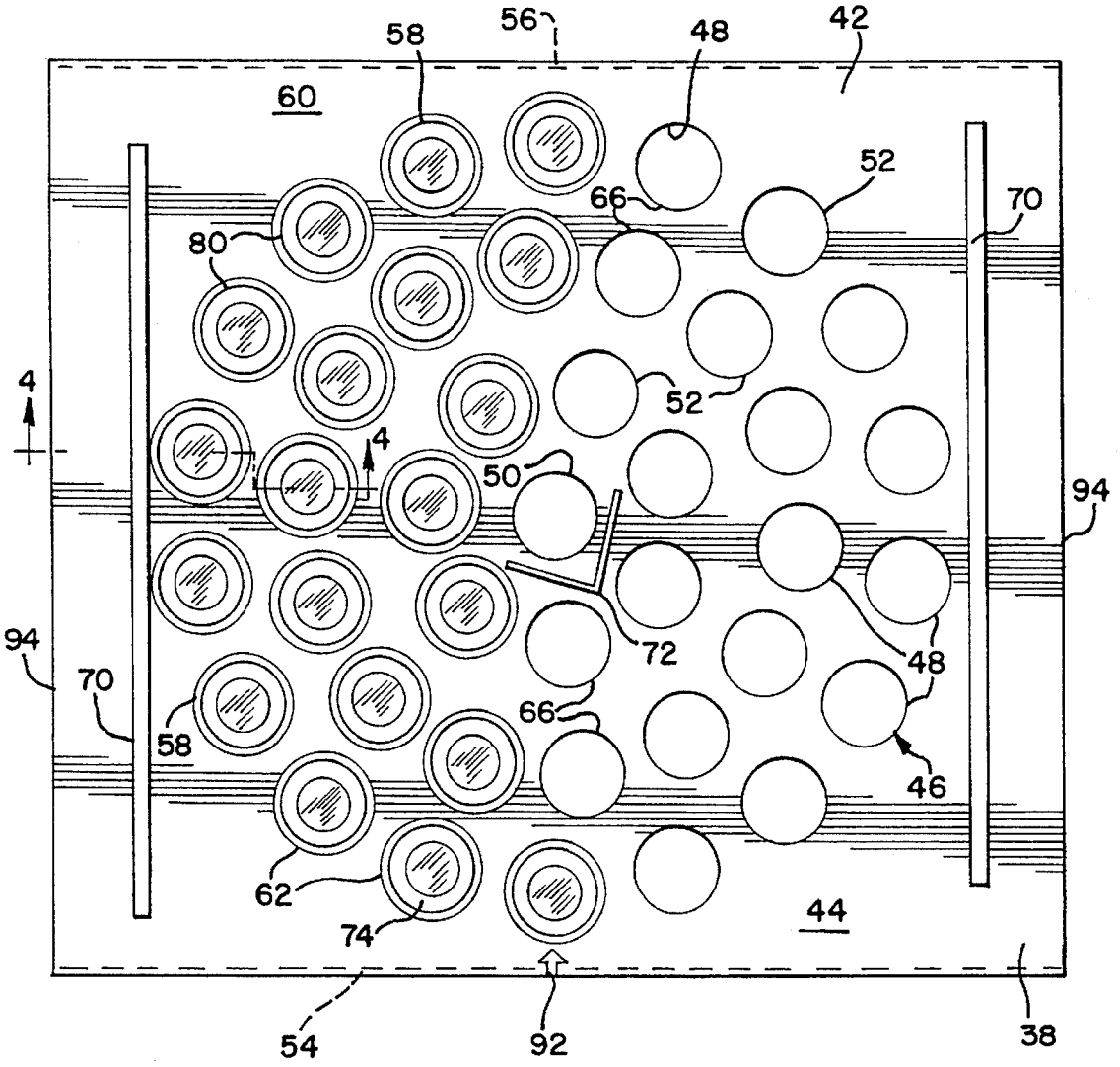
FIG. 3 is a plan view of the cup divider stack; for the purpose of explanation only part of the cup divider stack is shown loaded with cups.

If the master hole of the tray insert 86 has been identified by, for example by a mark (not shown) on a bottom of the tray insert 86, the tray insert 86 is positioned to place its master hole next an arrow 92 displayed on that particular cup divider 42, see FIGS. 2 and 3. If the master hole has not been previously identified, then the tray insert 86 is moved about until its cup holes 90 align with the cups 58 on the cup divider 42. The insert master hole then may be marked to facilitate insert hole-cup alignment in the future.

With the cups 58 located in the holes 90 of the tray insert 86, the tray base 88 is refitted to the tray insert 86. The cup divider 42, the cups 58 thereon, and the tray 84 then are lifted from the divider stack 38 and inverted. During this movement the respective side edges 94 of the divider panel 44 accommodate ready manual gripping of the divider 42 while the respective divider front and rear flanges 54, 56 provide divider rigidity. Finally, the cup divider 42 is discarded leaving the cups 58 in the tray 84 ready for filling.

Note that when the divider 42 is lifted from the stack 38, loosely nested cups 58 on the cup divider 42 below do not interfere with this lifting action. Note further that the gravity fit between each divider 42 and its cups 58 is cancelled upon the divider inversion. Thus, there is little to interfere with scrapping the cup divider 42 after the tray 84 is upright.

Upon the removal of the divider 42 and its cups 58 from the stack 38, the next lower cup divider 42 and its cups 58 are exposed for transfer to a further communion tray 84 in a like manner. When the bottom divider 42*a* and its cups 58*a* are so exposed, there are no cups 58 below to maintain the location of the cups 58*a*. Therefore, the person transferring the cups 58*a* to a communion tray 84 must take care not to dislodge any cups 58*a*.

While an embodiment, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A package for shipping, storing and readily transferring sets of open-ended containers for subsequent use, said package comprising:

a stack of spaced apart dividers, a set of openings in each said divider, and one each of said sets of said containers respectively carried on said dividers with respective open ends of said containers of said sets freely seated about said openings in said dividers and closed base portions of said containers of each said set forming respective loose fits with said openings in said dividers respectively above said divider carrying said containers, wherein during shipment and storage of said containers, said loose fits between said base portions of said containers and said openings in said respectively above dividers maintain said containers in loosely nested sleeves that then facilitate transferring said sets of said containers.

2. A package as defined by claim 1 and further characterized by including, a carton comprising a bottom panel, spaced apart side panels, and folded edges, said folded edges respectively connecting said side panels to said bottom panel, wherein said bottom panel and said side panels define in part an inner space where said stack of said dividers is disposed during shipment and storage with said bottom panel and said side panels fitting about said stack of said dividers to in part inhibit dislocation of said dividers, and then during transfer of said containers from said carton said side panels are swung about said folded edges and away from said stack of said dividers to provide access to said dividers.

3. A package as defined by claim 1 and further characterized by, said stack of spaced apart dividers including 15 cup dividers to carry said containers, and said set of openings in each said divider being 40 openings arranged to provide a center opening and rows of openings positioned concentrically about said center opening, wherein said package may accommodate 600 said containers.

4. A package as defined by claim 1 and further characterized by, said spaced apart dividers being separated by spaces, said spaces having respective heights less than the height of one said container, and said containers selectively aligning to form sleeves with at least four said containers in each said sleeve positioned in an overlapping relationship.

5. A package as defined by claim 1 and further characterized by, said stack of said dividers including one said divider defined by a panel for one said set of said openings, end flanges formed on opposing ends of said panel, and edges forming sides of said panel connecting said end flanges, wherein said side edges allow ready hand gripping of said divider and said end flanges add rigidity to said divider.

6. A package as defined by claim 1 and further characterized by, said stack of said dividers including a top shipping divider being free from carrying said containers.

7. A package as defined by claim 1 and further characterized by including, locating means to identify an aligning position between said containers and holes in an insert of a tray, wherein said locating means promotes ready placement of said containers in the tray insert holes.

8. A package as defined by claim 7 and further characterized by, said locating means defined by an arrow on a top surface of a panel of one said divider of said stack of said dividers.

9. A package for shipping, storing, and readily transferring sets of open-ended containers for subsequent use, said package comprising:

a stack of spaced apart dividers, a set of openings in each said divider, and one each of said sets of said containers respectively carried on said dividers with respective open ends of said containers of said sets freely seated about said openings of said dividers and closed base portions of said containers of said sets forming respective loose fits with said openings in said dividers respectively above to said dividers carrying said containers, said package further including sets of spacers located respectively between said dividers with each said set of spacers comprising, a pair of individual elongated strips, and an individual center strip, wherein during shipment and storage of said containers, said loose fits between said base portions of said containers and said openings in said respective above dividers maintain said containers in loosely nested sleeves that then facilitate transferring said containers of said sets.

10. A package comprising:

a carton having an inner space, a stack of spaced apart dividers carried in said inner space of said carton, sets of openings in said dividers forming columns of said openings in said stack, and a series of inverted cups selectively carried on said dividers and positioned to have open bottom ends freely seated respectively over said openings, and said cups having closed base portions extending respectively loosely through said openings in a next above divider to loosely nest in respective inner spaces of said cups carried on said next above divider, wherein cups on successive dividers may be readily transferred to successive trays by fitting respectively said cups on said successive dividers into holes in respective inserts of the successive trays.

11. A package for shipping and storing communion cups and then for transferring sets of said cups to communion trays, said package comprising:

a carton having a bottom panel, a pair of spaced apart side panels, and a pair of folded edges, said folded edges respectively connecting said side panels to said bottom panel and allowing ready rotational movement of said side panels, a stack of cup dividers and a top shipping divider carried in said carton, said dividers having side edges for ready user engagement, a series of spacer strips located between said dividers to space said dividers respectively apart a distance less than the height of one said cup, a set of openings formed in each said cup divider and in said shipping divider, said openings of said sets being positioned to selectively align with similarly positioned cup holes in an insert of the communion tray, and a set of said communion cups carried on each said cup divider, said cups of said sets inverted to have respective open ends freely seating on said cup dividers about said cup divider openings and respective base portions extending loosely through said openings in said divider above said divider on which said cups are seated, wherein for transfer of said cups to the tray, first said shipping divider is removed from said stack, second the insert of the tray is inverted and placed over said cups on the uppermost cup divider of said stack to fit said cups into cup holes in the insert, next an inverted base of the tray is fitted to the insert to reform the tray, then said uppermost cup divider, said cups thereon, and the tray are lifted from said stack and inverted, and lastly said uppermost cup divider is discarded to allow filling of said cups for subsequent use in a service of communion.

* * * * *